US006309181B1

(12) United States Patent
Etschel

(10) Patent No.: US 6,309,181 B1
(45) Date of Patent: Oct. 30, 2001

(54) FLUID FLOW MACHINE WHEEL AND USES THEREOF

(75) Inventor: Helmut Etschel, Hof (DE)

(73) Assignee: EMU Unterwasserpumpen GmbH (DE)

( * ) Notice: Subject to any disclaimer, the term of this patent is extended or adjusted under 35 U.S.C. 154(b) by 0 days.

(21) Appl. No.: 09/515,478

(22) Filed: Feb. 29, 2000

(30) Foreign Application Priority Data

Mar. 11, 1999 (DE) ..... 199 10 813

(51) Int. Cl.[7] ..... B63H 1/06; B64C 11/12; F01D 29/18

(52) U.S. Cl. ..... 416/134 R; 416/222

(58) Field of Search ..... 416/134 R, 134 A, 416/140, 500, 210 R, 204 R

(56) References Cited

U.S. PATENT DOCUMENTS

| | | | | |
|---|---|---|---|---|
| 2,041,507 | * | 5/1936 | Zeder | 416/134 R X |
| 2,492,029 | * | 12/1949 | Beier | 416/134 R X |
| 2,558,589 | * | 6/1951 | Skolfield | 416/134 R X |
| 2,638,761 | * | 5/1953 | Henry | 416/134 R X |
| 2,680,559 | * | 6/1954 | Morrill | 416/134 R X |
| 2,690,063 | * | 9/1954 | Davis | 416/134 R X |
| 2,802,353 | * | 8/1957 | Peirce | 416/134 R X |
| 3,084,963 | * | 4/1963 | Beehler | 416/134 R X |
| 3,865,510 | * | 2/1975 | Yoshino | 416/134 R |
| 4,147,468 | * | 4/1979 | Murakami et al. | 416/244 R X |
| 5,464,323 | * | 11/1995 | Scofield | 416/134 R |

FOREIGN PATENT DOCUMENTS

| | | |
|---|---|---|
| 578128 | 6/1933 | (DE) . |
| 759535 | 1/1953 | (DE) . |

* cited by examiner

*Primary Examiner*—John E. Ryznic
(74) *Attorney, Agent, or Firm*—Schweitzer Cornman Gross & Bondell L.L.P.

(57) ABSTRACT

A fluid flow machine wheel as for an immersion agitator or for a waste water, slurry, sewage or feces pump or for a recirculation pump, comprises a shaft hub having an inner hub portion and an outer hub portion, between which there is disposed a hub damping element comprising an elastic material. Blades project from the outer hub portion. Blade damping elements of elastic material are provided between the outer hub portion and each respective blade. The fluid flow machine wheel may have either only the hub damping element or only the blade damping elements. The damping element or elements at least reduce vibration of or damage to the wheel or its drive motor, transmission, mountings for same and so forth, caused by uncontrolled hydraulic conditions or properties and afflux flows.

6 Claims, 6 Drawing Sheets

FLUID FLOW MACHINE WHEEL AND USES THEREOF

FIELD OF THE INVENTION

The present invention concerns a fluid flow machine wheel and uses thereof.

The term fluid flow machine wheel is used in this specification to denote a wheel member forming part of a machine involving a flow of fluid therethrough, for example an agitator such as an immersion agitator or a pump for pumping waste water, slurry, sludge, sewage or feces, or a recirculation pump. Such a wheel may be for example in the form of an impeller in a pump.

BACKGROUND OF THE INVENTION

A typical form of fluid flow machine wheel comprises an inner hub portion and an outer hub portion which are connected together to form a hub to be mounted on a shaft, with blades or vanes projecting away from the outer hub portion. It has been found that when a fluid flow machine wheel of that kind is used in relation to a medium involving uncontrolled hydraulic conditions or properties such as waste water, sewage, feces, liquids carrying sludge or slurry, or the like, it is virtually inevitable that the wheel suffers from shocks, impacts and knocks as a result of changing operating conditions such as varying consistency of the medium passing through the machine. Such effects on the wheel can result in undesirable vibration phenomena and in an extreme case can even result in irreversible damage to the wheel or a drive motor connected thereto, a transmission assembly, mountings for same, and so forth.

A bladed wheel for a suction cleaner is to be found in German patent specification No. 578 128, comprising a shaft hub involving an inner hub portion and an outer hub portion, with blades projecting away from the outer hub portion. Disposed between the inner hub portion and the outer hub portion is a hub damping element of an elastic material which is intended to provide a sound-damping action. Shocks or impacts as are possible or inevitable in the case of a fluid flow machine wheel of the kind to which the invention relates, in use in the above-indicated circumstances involving a medium entailing uncontrolled hydraulic conditions or properties are not relevant in regard to such suction cleaner impellers.

German patent specification No. 759 535 describes a fan impeller of which the blades are connected to a motor shaft with the interposition of disks or the like of elastic rubber. The blades are secured to the rubber disks individually and separately from each other in such a way that the masses thereof are connected together only by way of the rubber disks but do not have any contact with each other. That impeller therefore does in fact have an inner hub portion, but there is no outer hub portion. On the contrary, in that arrangement the blades are independent components which are separate from each other.

Shocks and impacts as in the case of a fluid flow machine wheel involving the circumstances with which the present invention is concerned are also not to be expected with the impeller of German patent specification No. 759 535.

SUMMARY OF THE INVENTION

An object of the present invention is to provide a fluid flow machine wheel adapted to resiliently absorb and cushion shock and impact loadings thereon and consequently at least reduce vibration and/or damage.

A further object of the present invention is to provide an impeller wheel for a fluid flow machine such as an agitator or pump which is structurally capable of better withstanding shock loadings on component parts thereof without involving a structural configuration that is difficult and complicated to manufacture and assemble.

In accordance with the principles of the present invention the foregoing and other objects are attained by a fluid flow machine wheel, for example and more particularly for an immersion agitator or for a waste water, slurry, sludge, sewage or feces pump or for a recirculation pump, comprising a shaft hub for mounting on a shaft, comprising an inner hub portion and an outer hub portion. The outer hub portion and the inner hub portion are connected together in mutually interlacing relationship and blades project from the outer hub portion. A hub damping element of elastic material is provided between the inner hub portion and the outer hub portion and/or respective blade damping elements of elastic material are provided between the outer hub portion and the respective blade.

In accordance with the invention therefore, as will be seen in further detail from the description hereinafter of preferred embodiments, it is possible to only provide a hub damping element between the inner hub portion and the outer hub portion, or only blade damping elements between the outer hub portion and the respective blade, or a hub damping element between the inner hub portion and the outer hub portion as well as blade damping elements between the outer hub portion and each respective blade. The respective design configuration adopted is more particularly dependent on the kind of media in relation to which the wheel is to be used.

In the case of the fluid flow machine wheel according to the invention therefore both the corresponding torque and also the respective thrust force are suitably transmitted, while shock or impact loadings as a result of uncontrolled hydraulic conditions or properties in respect of the medium with which the wheel is being used are advantageously cushioned and damped by the hub damping element and/or by the blade damping elements. The advantage resulting from this is that undesired vibration phenomena or in the extreme case irreversible damage to the fluid flow machine wheel according to the invention or a drive motor connected thereto, a transmission arrangement, mountings for same and so forth, can be at least reduced or even prevented in a simple fashion.

The fact that, in the case of the wheel according to the invention the outer hub portion and the inner hub portion are connected together in interlaced or mutually interengaging arrangement provides that, if the resilient spring force of the hub damping element is exceeded or in the event of wear thereof, for example and in particular after a long period of use or operation of the wheel, the torque-transmitting properties afforded by the co-operation of the inner and outer hub portions for transmitting torque from the drive motor of the machine to the blades, that is to say between the shaft hub of the wheel and the blades, are still maintained. The fact that wear of the hub damping element occurs or the resilient spring force is exceeded does not result in effective disablement of the wheel and thus means that it is guaranteed to be capable of continuing to operate at any time in an emergency operating mode.

The wheel according to the invention can have two or more than two blades which are arranged equidistantly in the peripheral direction of the wheel.

In a preferred feature of the invention the hub damping element of the wheel can be of a ring-shaped or sleeve-shaped configuration. It can comprise a cast or molded elastomer, for example a plastic material or a rubber material. It is likewise also possible for the hub damping element to have at least one spring element. The at least one spring element can be for example in the form of an annular spring or the like.

The blade damping elements can be of a ring-shaped configuration and, like the hub damping element, can comprise a plastic or a rubber material. They may also be formed for example by springs such as plate or diaphragm springs or the like, sleeve elements comprising an elastomer material, and other suitable spring configurations.

It will be noted in this respect that the blade damping elements are advantageous in particular when shock or impact loadings as a consequence of uncontrolled hydraulic conditions or properties of the respective medium in which the wheel is being used are already to be at least in part absorbed, that is to say damped, at the blades themselves, in order thereby to reduce or minimise shock or impact loadings in the region of the hub shaft of the wheel.

The configuration of the wheel involving the blade damping elements also affords the advantage that the blade damping elements can be subsequently fitted to previously existing fluid flow machine wheels. Such wheels may involve for example those of immersion motor agitators for example from the series 'Maxiprop' and 'Megaprop' from EMU Unterwasserpumpen GmbH, Germany.

The wheel according to the invention can advantageously be used in relation to all kinds of impellers and propellers in regard to which there is the danger of a hydraulic afflux flow which is irregular due to the medium involved. It will be appreciated that the wheel according to the invention can also be used in relation to a regular hydraulic afflux flow. Although reference has been made to the wheel according to the invention being used more particularly in relation to an immersion agitator or a pump such as a waste water, slurry, sludge, sewage or feces pump or a recirculation pump, the wheel according to the invention is however not limited to such uses and areas of operation.

Further objects, features and advantages of the present invention will be apparent from the description hereinafter of preferred embodiments thereof.

DESCRIPTION OF PREFERRED EMBODIMENTS

Figure 1:
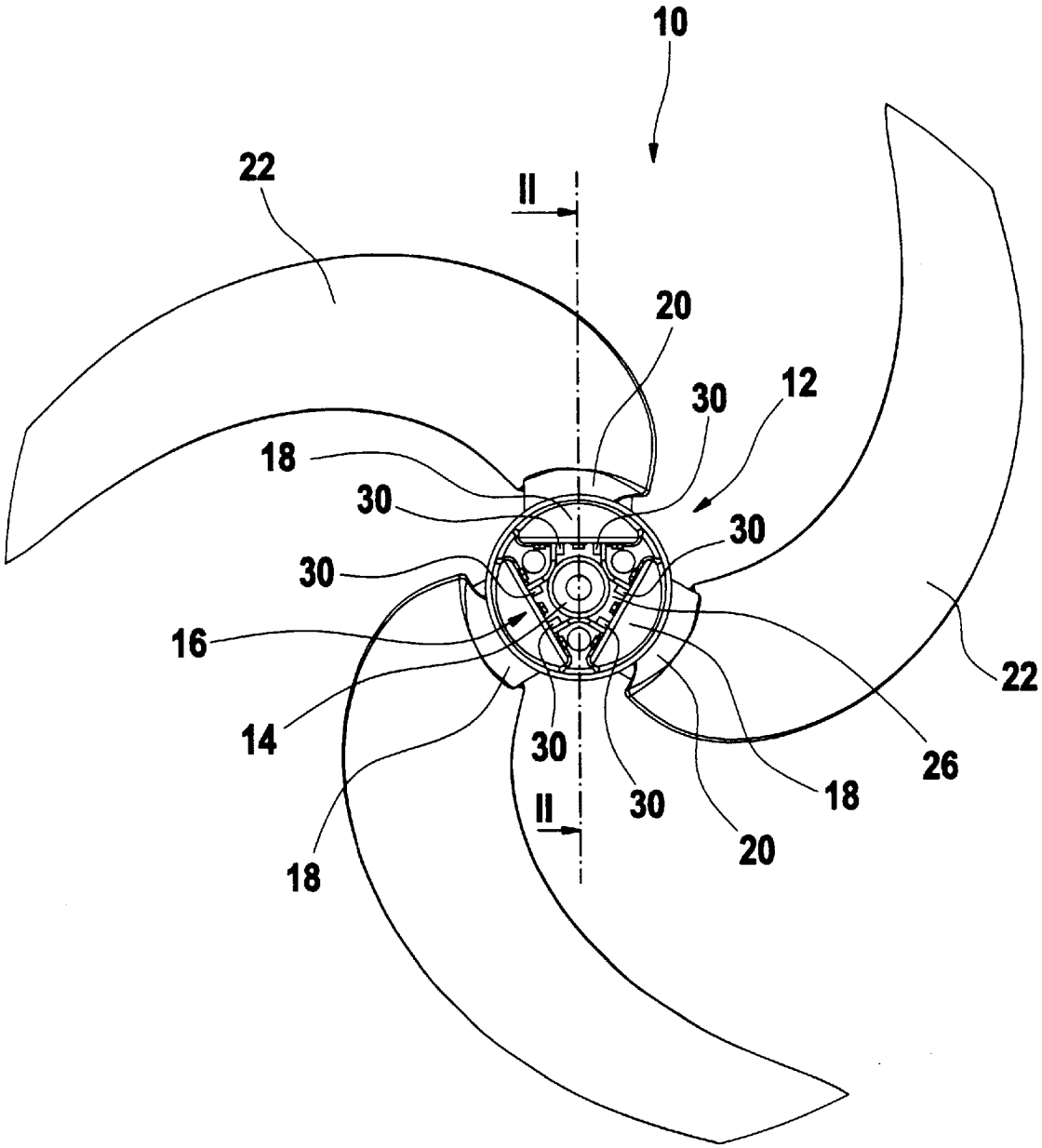
FIG. 1 is a front view of a first embodiment of a fluid flow machine wheel according to the invention.
Figure 2:
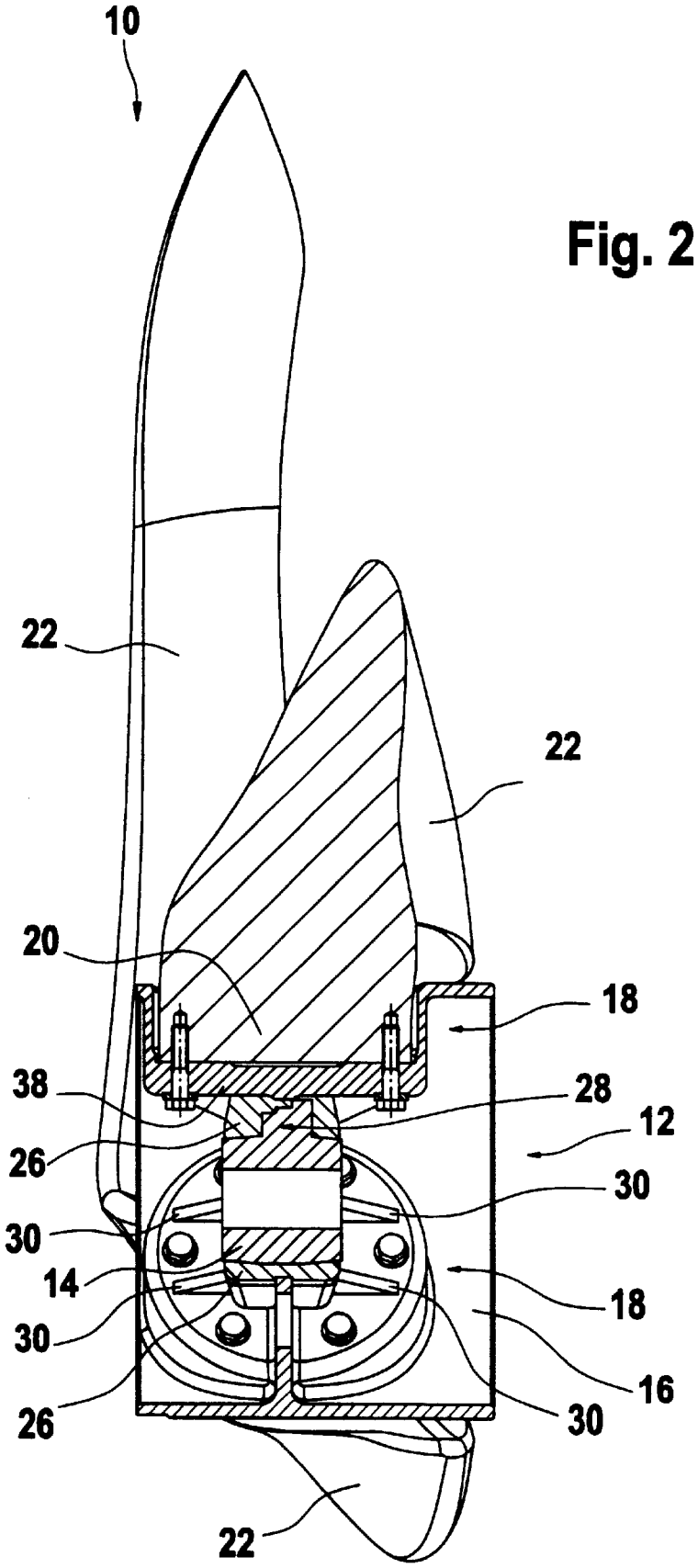
FIG. 2 is a view on an enlarged scale in section taken along line II—II in FIG. 1.
Figure 3:
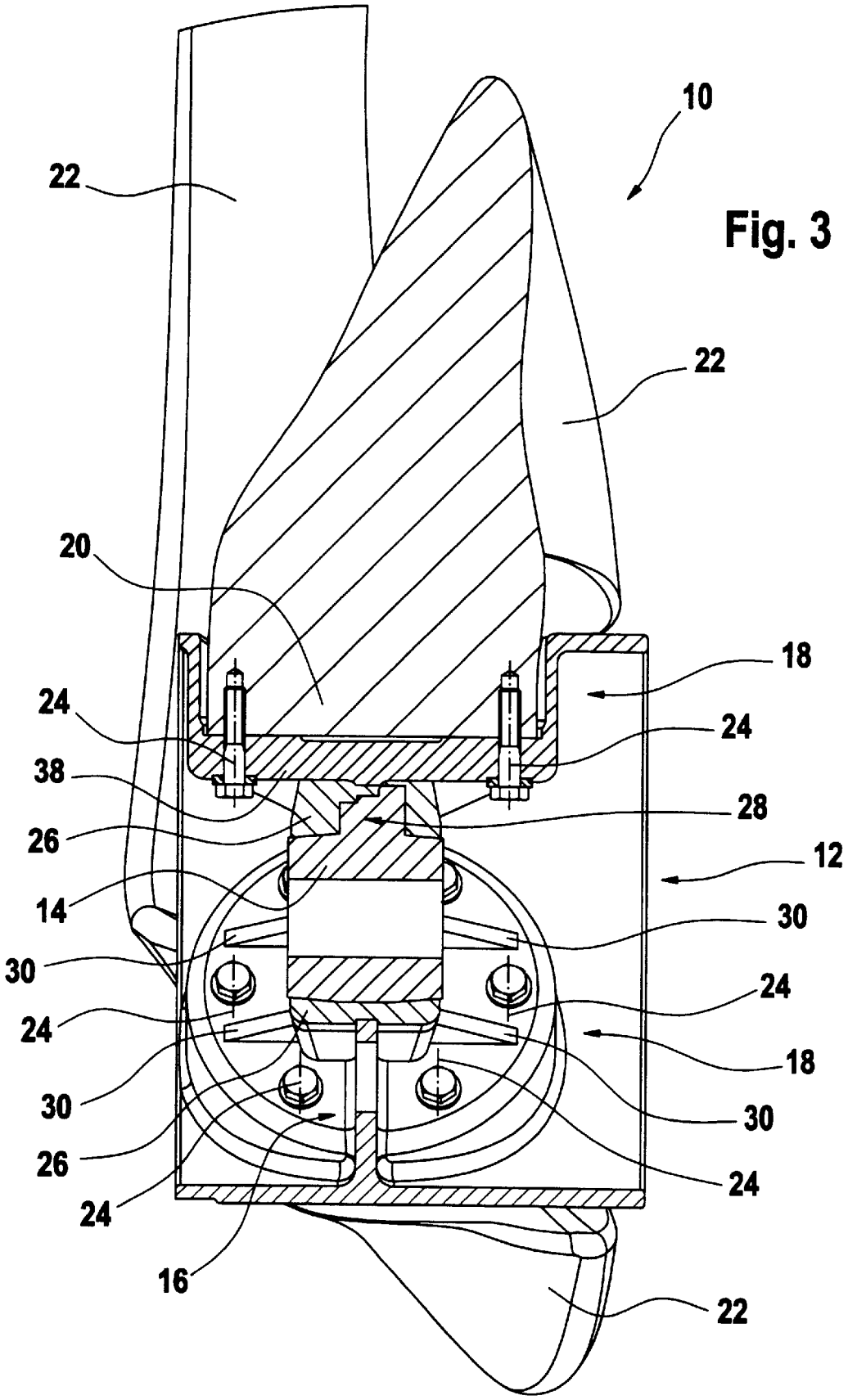
FIG. 3 is the sectional view of FIG. 2 on a further enlarged scale.

Reference will first be made to FIGS. 1, 2 and 3 to describe a first embodiment of a fluid flow machine wheel 10 according to the invention, which can be used for example for an immersion agitator or a pump, comprising a shaft hub 12 which includes an inner hub portion 14 and an outer hub portion 16. The outer hub portion 16 has peripherally equidistantly distributed recesses or openings 18 which are provided to receive root portions 20 of blades 22 which thus extend away from the outer hub portion 16. The blades 22 are fixed with their root portions 20 in the associated recesses of the outer hub portion 16 by screws of which only the center lines thereof are indicated in FIGS. 2 and 3 by means of thin dash-dotted lines indicated at 24 in FIG. 3. Those screws are arranged at uniform spacings from each other along part of a circle. The root portions 20 of the blades 22 are of a circular edge contour or base configuration.

Operatively disposed between the inner hub portion 14 and the outer hub portion 16 is a hub damping element 26 which is formed for example by a cast or molded elastomer such as a plastic material or a rubber material. It will be seen from the drawing that the hub damping element 26 is of a generally ring-shaped or sleeve-shaped configuration.

The inner hub portion 14 and the outer hub portion 16 are connected together in mutually interengaging or interlacing relationship. For that purpose the inner hub portion 14 is formed with radially outwardly projecting protrusions 28 and the outer hub portion 16 is provided with inwardly oriented protrusions 30.

Figure 4:
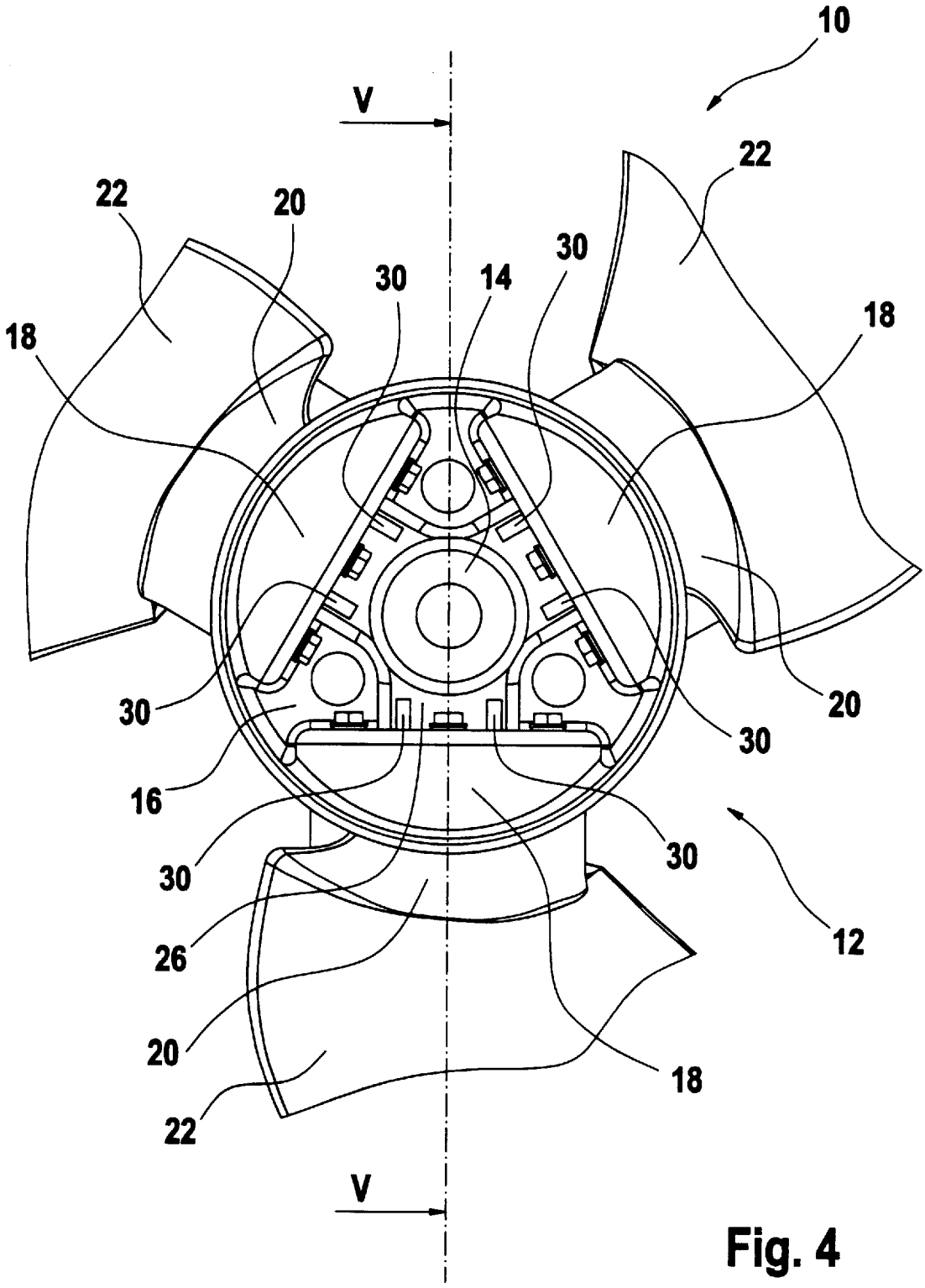
FIG. 4 is a front view on a larger scale of a second embodiment of the fluid flow machine wheel, with the blades being shown in cut-away form.
Figure 5:
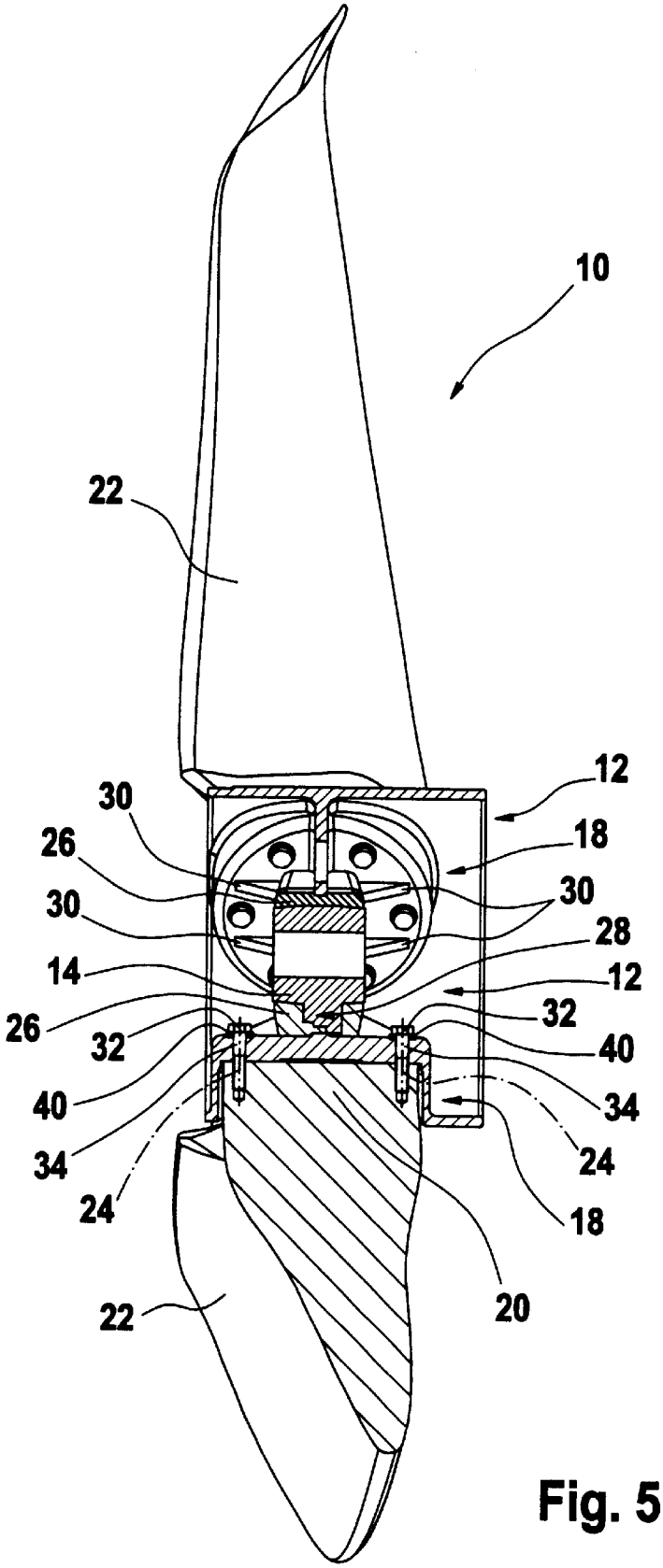
FIG. 5 is a view in section taken along line V—V in FIG. 4 through the fluid flow machine wheel.
Figure 6:
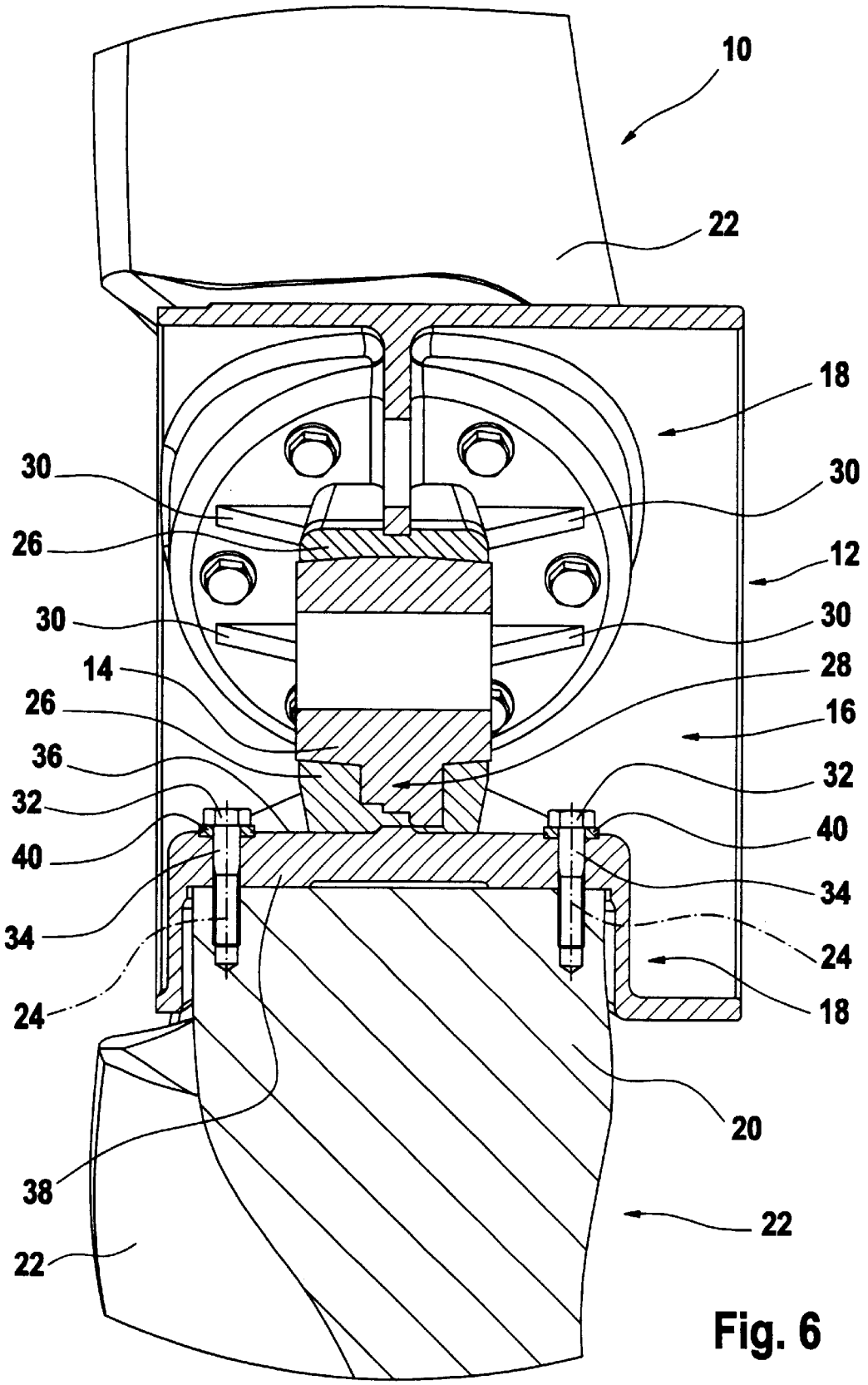
FIG. 6 is the view in section of FIG. 5 on a further enlarged scale, with the blades once again only being shown in cut-away form.

Referring now to FIGS. 4, 5 and 6, shown therein is a second embodiment of a fluid flow machine wheel 10. This second embodiment differs from that illustrated in FIGS. 1 through 3, more particularly in that not only is there a hub damping element 26 operatively disposed between the inner hub portion 14 and the outer hub portion 16 of the shaft hub, but that in addition operatively disposed between heads 32 of fixing screws 34, the center lines of which are again identified by reference numeral 24, and the inside 36 of the bottom of the respective recesses 18 which accommodate the root portions 20 of the respective blades 22 are blade damping elements indicated at 40. In that way it is already advantageously possible to absorb and damp some of the impact or shock loadings as can occur for example due to uncontrolled hydraulic conditions or properties in respect of the medium in which the illustrated wheel 10 is operating, in order thereby to avoid in a further improved fashion vibration effects of or damage to the wheel 10 or its drive motor, a transmission arrangement, mountings for same and so forth. It will be noted that the blade damping elements 40 which can be of a generally ring-shaped configuration as shown and which can suitably comprise a material such as a plastic material or a rubber material can also be subsequently fitted (retro-fitting) to wheels 10 which are already available on the market in order to add the vibration-damping and damage-limiting capability thereto.

It will be appreciated that the same details as shown in FIGS. 4, 5 and 6 in relation to the second embodiment are denoted by the same references as those employed in relation to the first embodiment described with reference to FIGS. 1 through 3, so that there is thought to be no need to describe all features identified by such references again in detail at this juncture.

It will be appreciated that if the wheel only has blade damping elements 40 operatively disposed between the outer hub portion 16 and the respective blades 22, then the shaft hub 12 could also be of a generally one-piece configuration, with the inner hub portion 14 and the outer hub portion 16 then being of an integrally designed structure.

It will be appreciated that the above-described embodiments have been set forth solely by way of example and illustration thereof and that various other modifications may be made therein without thereby departing from the spirit and scope of the invention.

What is claimed is:

1. A fluid flow machine wheel comprising a shaft hub including an inner hub portion and an outer hub portion, blades projecting from the outer hub portion, radially disposed connecting elements joining said blades to said outer hub portion, and blade damping elements of elastic material interposed between inwardly facing surfaces of said outer hub portion and outwardly facing surfaces of said connecting elements.

2. A fluid flow machine wheel, comprising a shaft hub including an inner hub portion and an outer hub portion, means connecting the outer hub portion and the inner hub portion in interlaced mutually interengaging connected relationship, a hub damping element of elastic material between the inner hub portion and the outer hub portion, and blade damping elements of elastic material between the outer hub portion and the respective blades.

3. A fluid flow machine wheel, comprising:

a shaft hub including an inner hub portion and an outer hub portion, means connecting the outer hub portion and the inner hub portion in interlaced mutually interengaging connected relationship, blades projecting from the outer hub portion, and damping means of elastic material operatively disposed between the inner hub portion and the outer hub portion.

4. A fluid flow machine wheel as set forth in claim 1 wherein the damping means comprise a hub damping element of elastic material between the inner hub portion and the outer hub portion.

5. A fluid flow machine wheel as set forth in claim 4 wherein the hub damping element comprises a plastic material.

6. A fluid flow machine wheel as set forth in claim 4 wherein the hub damping element comprises a rubber material.

* * * * *